US005474713A

United States Patent [19]

Faber

[11] Patent Number: 5,474,713

[45] Date of Patent: Dec. 12, 1995

[54] HIGH ACTIVES CLEANING COMPOSITIONS AND METHODS OF USE

[75] Inventor: Robert D. Faber, Grand Rapids, Mich.

[73] Assignee: Amway Corporation, Ada, Mich.

[21] Appl. No.: 217,115

[22] Filed: Mar. 23, 1994

[51] Int. Cl.[6] ..... C11D 1/75; B08B 7/00

[52] U.S. Cl. ..... 252/544; 252/114.21; 252/548; 252/551; 252/173; 252/DIG. 1; 252/DIG. 19; 134/25.1; 134/25.2; 134/40; 134/42

[58] Field of Search ..... 252/544, 541, 252/548, 174.21, 174.22, 174.17, 142, 173, DIG. 1, 551, DIG. 14; 134/25.1, 25.2, 40, 42

[56] References Cited

U.S. PATENT DOCUMENTS

| | | | |
|---|---|---|---|
| 3,682,849 | 8/1972 | Smith et al. | 260/615 B |
| 3,893,955 | 7/1975 | Hewitt et al. | 252/551 |
| 4,088,598 | 5/1978 | Williams | 252/135 |
| 4,248,729 | 2/1981 | Rubingh et al. | 252/174.22 |
| 4,316,824 | 2/1982 | Pancheri | 252/551 |
| 4,338,211 | 7/1982 | Stiros | 252/142 |
| 4,371,461 | 2/1983 | Jones et al. | 252/547 |
| 4,457,857 | 7/1984 | Sepulveda et al. | 252/174.21 |
| 4,492,646 | 1/1985 | Welch | 252/528 |
| 4,594,184 | 6/1986 | Cook et al. | 252/542 |
| 4,595,526 | 6/1986 | Lai | 252/545 |
| 4,732,704 | 3/1988 | Biermann et al. | 252/548 |
| 4,744,924 | 5/1988 | Hensen et al. | 252/551 |
| 4,759,868 | 7/1988 | Clarke | 252/170 |
| 4,784,800 | 11/1988 | Leng et al. | 252/548 |
| 4,818,427 | 4/1989 | Altenschoepfer | 252/174.21 |
| 4,824,605 | 4/1989 | Hildreth | 252/547 |
| 4,876,035 | 10/1989 | Breitzke et al. | 252/550 |
| 5,034,159 | 7/1991 | Tesmann et al. | 252/551 |
| 5,209,874 | 5/1993 | Kravetz et al. | 252/550 |
| 5,215,683 | 6/1993 | Kravetz et al. | 252/550 |
| 5,223,179 | 6/1993 | Connor et al. | 252/548 |

FOREIGN PATENT DOCUMENTS

| | | |
|---|---|---|
| 1158518 | 12/1983 | Canada . |
| 1163563 | 3/1984 | Canada . |
| 1239563 | 7/1988 | Canada . |
| 1255992 | 6/1989 | Canada . |
| 2012172 | 3/1990 | Canada . |
| 0034039 | 9/1984 | European Pat. Off. . |
| 0044582 | 11/1985 | European Pat. Off. . |
| 0088612 | 1/1987 | European Pat. Off. . |
| 0552032 | 7/1993 | European Pat. Off. . |
| 3533977 | 5/1986 | Germany . |
| 3635535 | 10/1987 | Germany . |
| 3717600 | 12/1988 | Germany . |
| 9319145 | 9/1993 | WIPO . |

*Primary Examiner*—Paul Lieberman
*Assistant Examiner*—Lorna M. Douyon

[57] ABSTRACT

Concentrated high active-cleaning compositions are prepared which exhibit excellent cleaning performance, dispersibility and homogeneity in solution. The compositions of the present invention include a nonionic surfactant such as fatty alcohol ethoxylates, alkyl phenol ethoxylates and alkyl polyglycosides and an amide cosurfactant such as fatty acid dialkanolamides. Optional ingredients can be included such as a secondary surfactant, a pH control agent, a hydrotrope, dyes, fragrances, preservatives, denaturing agents and the like. In one preferred embodiment, the high actives cleaning composition is used as a detergent base. A method is also disclosed for use of a detergent base. In another preferred embodiment, the concentrated cleaning composition is diluted by the end user to a desired strength for specific cleaning purposes. A method is also disclosed for use of the concentrated cleaning composition.

12 Claims, 2 Drawing Sheets

HIGH ACTIVES CLEANING COMPOSITIONS AND METHODS OF USE

BACKGROUND OF THE INVENTION

The present invention is directed to a high actives concentrated cleaning composition or, more particularly, to an all-purpose concentrated liquid cleaning composition comprised of a novel blend of nonionic surfactants which has an actives level of up to 100%. Methods for using such compositions are also disclosed.

There has long been a desire to produce concentrated cleaners for industrial and consumer use. Concentrated cleaners provide high strength cleaning for difficult soils and economical solutions when diluted for ordinary use. The sale of concentrated cleaners also minimizes packaging and transportation costs.

While concentrated heavy duty powder and liquid detergent compositions useful in laundry applications are known in the art, there is a need for highly concentrated liquid cleaners which can be diluted to a strength preferred by the end user and which can be used in general all-purpose cleaning applications such as hard surface cleaning, kitchen utensil cleaning, hand washing, sink laundry applications and the like. Such concentrated cleaning compositions can be used as is or diluted in a variety of ways such as in a bucket dilution or spray bottle dilution.

General all-purpose cleaning compositions are currently known in the art. A typical approach to formulating a general all-purpose cleaner is to use a mixture of anionic and nonionic surfactants. Anionic surfactants are almost always included in general all-purpose cleaners because anionic surfactants provide foam levels which are acceptable to the consumer. These formulations are typically diluted with water and sold as ready-to-use preparations. Further, compositions which have actives in the range of 30% to 50% of the composition are known in the art. However, problems have been encountered when trying to formulate cleaning compositions with actives levels above this range. High active systems above this range typically suffer from undesirable viscosity profiles. For example, gel regions at certain concentrations can cause a steep viscosity rise with increased actives levels or unacceptable dispersibility in water due to gelling upon dilution. Naturally, such a product is difficult for the consumer to use since it may not flow and may not disperse readily with water. Additionally, such high actives systems can lack homogeneity, thus requiring agitation by the consumer before and during use in order to obtain an equal dispersion of actives material.

SUMMARY OF THE INVENTION

The present invention relates to a concentrated liquid cleaning composition with an actives level of up to 100%, more particularly an actives level of up to about 90% and most particularly an actives level above 65%. In a first preferred embodiment, a high actives detergent base and a method of use is disclosed. In a second preferred embodiment, a concentrated all-purpose cleaning composition which can be diluted to a preferred strength by the end user and a method of its use is disclosed. The all-purpose dilutable compositions of the present invention comprise:

a) from about 10% to about 90% of at least one nonionic surfactant such as a fatty alcohol ethoxylate, an alkyl phenol ethoxylate, an alkyl polyglycoside and mixtures thereof;

b) from about 10% to about 90% of at least one amide cosurfactant and mixtures thereof;

c) from about 0% to about 10% of a secondary surfactant;

d) from about 0% to about 15% of a hydrotrope;

e) from about 0% to about 50% of water, additives, a pH control agent and mixtures thereof.

The high active detergent base of the compositions of the present invention comprise:

a) from about 10% to about 90% of a nonionic surfactant such as a fatty alcohol ethoxylate, an alkyl phenol ethoxylate, an alkyl polyglycoside and mixtures thereof; and b) from about 10% to about 90% of at least one amide cosurfactant and mixtures thereof.

The high actives cleaning compositions of the present invention can be used as both a detergent base and as a readily dilutable concentrated all-purpose liquid cleaner. In a preferred embodiment of the present invention, a high active detergent base comprising a nonionic surfactant such as one or more of a fatty alcohol ethoxylate, an alkyl phenol ethoxylate and an alkyl polyglycoside in combination with an amide cosurfactant in blends ranging from a ratio of 9:1 to 1:9 is disclosed. In another preferred embodiment of the present invention, a composition which can be used either neat or readily dilutable by the end user in ranges of 1:1 to 1:2000 is disclosed which comprises a nonionic surfactant such as one or more of a fatty alcohol ethoxylate, an alkyl phenol ethoxylate, and an alkyl polyglycoside in combination with an amide cosurfactant and, optionally, other detergent constituents such as secondary surfactants, hydrotropes, fragrances, dyes and the like. It has been surprisingly found that despite the high levels of nonionic surfactant, particularly fatty alcohol ethoxylates which were expected to create gelling and dilution problems, the compositions of the present invention provide up to 100% active matter in a diaphanous, flowable, water dispersible form. The compositions of the present invention unexpectedly show homogeneity, dispersibility in water without gelling and rapid dilutability. These compositions can be dispensed in bucket applications, sink applications and hand-held sprayers and, more particularly, are useful in a hand-held sprayer such as is found in U.S. Pat. Nos. 5,152,461 and 5,332,157, both of which are incorporated by reference.

DESCRIPTION OF THE PREFERRED EMBODIMENT

Figure 1:
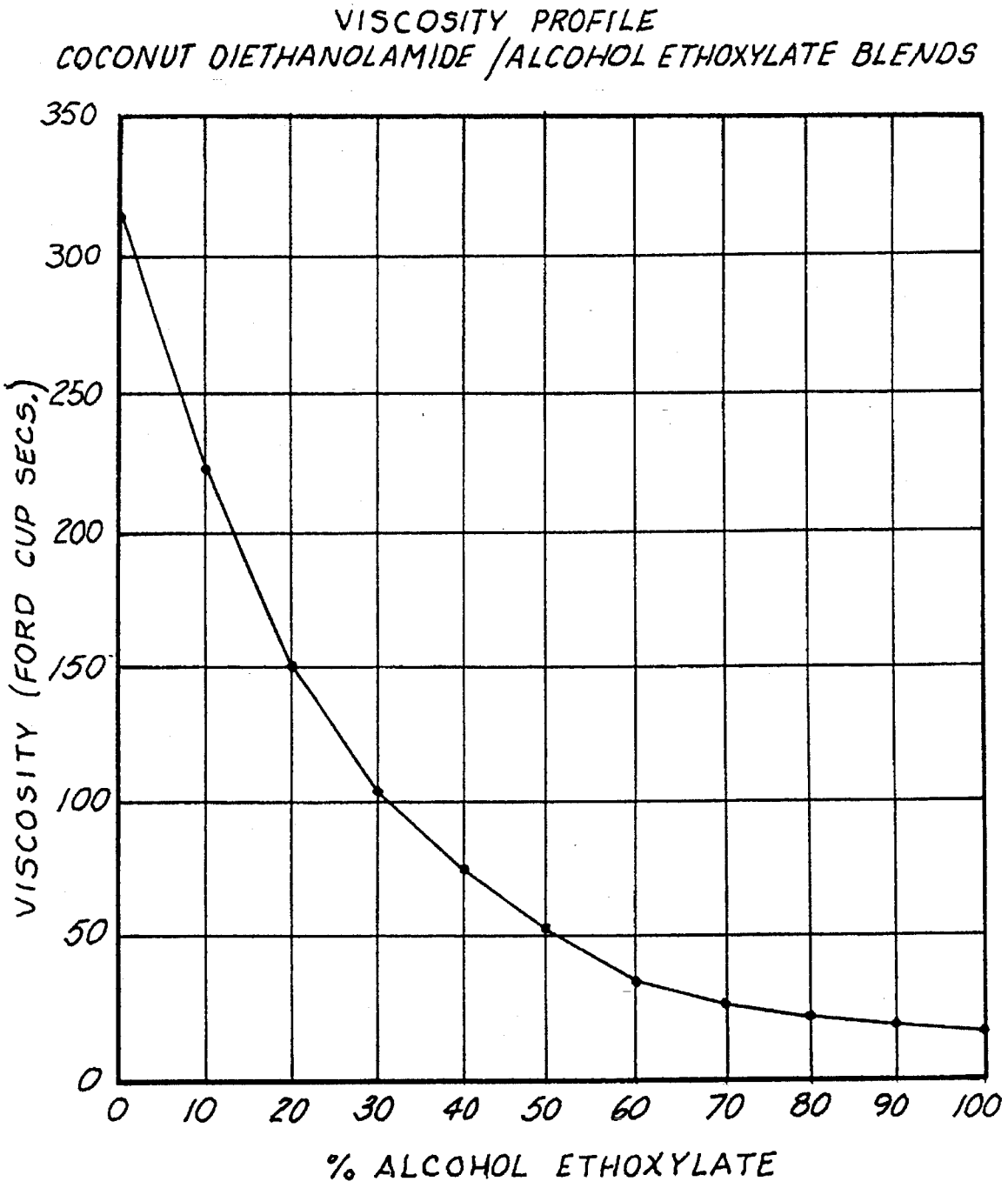
FIG. 1 is a graph of embodiments of the invention depicting a viscosity profile for various blends of alcohol ethoxylate and coconut diethanolamide.

In the first preferred embodiment, a concentrated all-purpose liquid cleaning composition with actives levels of preferably up to 100%, more preferably up to about 90% and most preferably above 65%, which is designed to be used neat or diluted to the end user's preferred strength, is disclosed comprising at least one nonionic surfactant and at least one amide cosurfactant. Optional ingredients such as secondary surfactants, hydrotropes, water, pH control agents and other additives such as preservatives, dyes and the like can be added but are not necessary. The compositions of this invention are useful in light duty cleaning applications such as hard surface cleaning, kitchen utensil cleaning, hand washing, sink laundry applications and the like. The dilution can be accomplished either by a bucket dilution or any type of hand-held sprayer and, more preferably, can be obtained from a hand-held sprayer such as is found in U.S. Pat. Nos. 5,152,461 and 5,332,157.

In a second preferred embodiment, a high actives detergent base composition with actives levels of up to 100% is disclosed comprising at least one nonionic surfactant such as fatty alcohol ethoxylates, alkyl phenol ethoxylates, alkyl polyglycosides and at least one amide cosurfactant, preferably $C_2$–$C_4$ dialkanolamides of coconut fatty acid. The high actives compositions of a preferred embodiment can be used in both heavy duty cleaning applications such as stain removal on clothes and fabric washing as well as light duty cleaning applications such as hard surface cleaning, hand washing, kitchen utensil washing and the like. The high actives detergent base can be blended with other detergent constituents to formulate consumer and industrial cleaning products.

In another preferred embodiment, a method for cleaning hard surfaces with the concentrated all-purpose cleaning compositions of the present invention is disclosed comprising the steps of diluting the concentrated cleaning composition with water in a ratio acceptable to the end user, applying the liquid cleaning composition to the surface to be cleaned and wiping the liquid cleaning composition along with entrained soil from the surface.

In another preferred embodiment, a method of using the high actives detergent base compositions of the present invention is disclosed comprising the steps of adding the high actives base to other detergent constituents such as solvents, water, pH control ingredients, secondary surfactants and other detergent additives such as dyes, fragrances, foam control agents and the like and thereafter using said mixture in heavy duty or light duty cleaning applications for consumer and industrial-related cleaning products.

The principle ingredients are included in the compositions of the present invention in the following percentages, based on total weight of the composition:

| | Preferred Range | More Preferred Rancie | Most Preferred Range |
|---|---|---|---|
| High Actives Detergent Base | | | |
| Nonionic Surfactant | 90%–10% | 80%–20% | 80%–60% |
| Amide Cosurfactant | 10%–90% | 20%–80% | 20%–40% |
| Concentrated Dilutable Composition | | | |
| Nonionic Surfactant | 10%–90% | 25%–75% | 45%–60% |
| Amide Cosurfactant | 10%–90% | 15%–60% | 20%–30% |
| Secondary Surfactant | 0%–10% | 1%–8% | 1.5%–5% |
| Hydrotrope | 0%–15% | 4%–13% | 8%–12% |
| pH Control Agent | ~1 | ~1 | .7%–.9% |
| Water and Other Optional Ingredients | balance | balance | balance |

Nonionic Surfactants

Substantially any liquid or liquefiable nonionic surfactant can be employed in the present invention. A comprehensive listing and discussion of nonionic surfactants can be found in *McCutcheon's Detergents and Emulsifiers* 1993 Annual and the textbook *Surface Active Agents,* Volume 2, by Schwartz, Perry and Berch (Inter. Science Publishers, 1958). Without limitation, further nonionic surfactants which can be used in the present invention are set forth in U.S. Pat. No. 3,929,678, which is incorporated herein by reference. Other suitable nonionics include but are not limited to:

1. The polyethylene oxide condensates of alkyl phenols. These compounds include the condensation product of alkyl phenols having from 1 to 15, preferably 4 to 12 carbon atoms in a straight chain or branch chain configuration with from 1 to 25, preferably 3 to 12 moles of ethylene oxide per mole of alkyl phenol. The alkyl substituents in such compounds can be derived, for example, from polymerized polypropylene, diisobutylene and the like. Examples of compounds of this type include nonylphenol condensed with about 9.5 moles of ethylene oxide per mole of nonylphenol; dodecyl phenol condensed with about 12 moles of ethylene oxide per mole of phenol; dinonylphenol condensed with about 15 moles of ethylene oxide per mole of phenol. Commercially available nonionic surfactants of this type include IGEPAL CO-710 marketed by Rhone-Poulenc, Inc.; and TRITON N-ill, N-150, x-100 and x-102 all marketed by Union Carbide Corporation.

2. The condensation products of aliphatic alcohols with from 1 to 25, and preferably 2 to 13 moles of ethylene oxide. The alkyl chain with the aliphatic alcohol can either be straight or branched, primary or secondary and generally contains from about 6 to about 22 carbon atoms. Examples of such alcohol ethoxylates include the condensation products of myristyl alcohol condensed with about 10 moles of ethylene oxide per mole of myristyl alcohol; and the condensation product of about 9 moles of ethylene oxide with coconut alcohol (a mixture of fatty alcohols with alkyl chains varying in length from 8 to 18 carbon atoms). Examples of commercially available nonionic surfactants of this type include TERGITOL 15-S-12 marketed by the Union Carbide Corporation, NEODOL® 1–7 marketed by the Shell Chemical Company and ALFONIC 1012-5 marketed by Vista Chemical Company.

3. The condensation products of ethylene oxide with a hydrophobic base formed by the condensation of propylene oxide with propylene glycol. The hydrophobic portion of these compounds has a molecular weight from about 1,500 to about 1,800 and exhibits water solubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation of up to about 40 moles of ethylene oxide. Examples of compounds of this type include certain of the commercially available PLURONIC® surfactants marketed by Wyandot Chemical Corporation.

4. The condensation products of ethylene oxide with a product resulting from the reaction of propylene oxide and ethylene diamine. The hydrophobic moiety of these products consists of the reaction product of ethylene diamine and excess propylene oxide, the moiety having a molecular weight from about 2,500 to about 3,000. This hydrophobic moiety is condensed with ethylene oxide to the extent that the condensation product contains from about 40% to about 80% by weight of polyoxyethylene and has a molecular weight from about 5,000 to about 11,000. Examples of this type of nonionic surfactant include certain of the commercially available TECTRONIC® compounds marketed by Wyandot Chemical Corporation.

5. Alkyl polysaccharides having a hydrophobic group containing from about 6 to about 22 carbon atoms, preferably from about 8 to about 18 carbon atoms and a polysaccharide, e.g., a polyglycoside, hydrophilic group containing from 1 to 10, preferably 1 to 4, most preferably 1.4 to 2.7 saccharide units. Any reducing saccharide containing 5 or 6 carbon atoms can be used, such as glucose, galactose and galactosyl moieties can be substituted for the glucosyl moieties. The hydrophobic group can be attached at the 2, 3 or 4 positions thus giving a glucose or galactose as opposed to a glucoside or a galactoside. The intersaccharide bonds can be between the 1 position of the additional saccharide units and the 2-, 3-, 4- and/or 6 positions of the preceding saccharide units. Optionally, and less desirably, there can be a polyalkylene oxide chain joining the hydrophobic moiety and the polysaccharide moiety. The preferred alkylene oxide is ethylene oxide. Typical hydrophobic groups include alkyl groups, either saturated or unsaturated, branched or unbranched containing from about 6 to about 22, preferably 8 to 18 carbon atoms. Preferably, the alkyl chain group is a straight chain saturated group. The alkyl group can contain up to 3 hydroxy groups and/or the polyalkylene oxide chain can obtain up to 10, preferably less than 5, most preferably 0, alkylene oxide moieties. Suitable alkyl polysaccharides are octyl, nonyl, decyl, undecyl, dodecyl, tridecyl, tetradecyl, pentadecyl, hexadecyl, heptadecyl and octadecyl, di-, tri-, tetra-, penta- and hexaglucosides, galactosides, lactosides, glucoses, fructosides, fructoses and/or galactoses. Suitable mixtures include coconut alkyl, di-, tri-, tetra- and pentaglucosides and tallow alkyl tetra- penta- and hexaglucosides. While 100% active alkyl polyglycosides are not currently offered commercially, they can be prepared by controlled drying of aqueous materials that are available at this time. Examples of useful starting point aqueous alkyl polyglycosides are GLUCOPON™ 225CS and GLUCOPON™ 425CS manufactured by Henkel Corporation.

6. Polyether surfactants which are condensation products of aliphatic alcohols and alkyl phenol alcohols with propylene oxide and ethylene oxide, usually in sequenced reaction of first propoxylating and second ethoxylating or first ethoxylating and second propoxylating. Examples of suitable polyether surfactants include certain of the commercially available Poly-Tergent surfactants marketed by Olin Chemicals.

Preferred nonionic surfactants are the fatty alcohol ethoxylates, alkyl phenol ethoxylates and alkyl polyglycosides.

More preferred nonionic surfactants useful in the present invention include the linear and branched fatty alcohol ethoxylates with about 6 to about 22 carbon atoms and from about 1 to about 25 moles of ethylene oxide, alkyl phenol ethoxylates having an alkyl group of from about 4 to about 12 carbon atoms and about 1 to about 25 moles of ethylene oxide per mole of alkyl phenol, alkyl polyglycosides with an alkyl group having about 6 to about 22 carbon atoms and 1 to 4 carbohydrate units and mixtures thereof.

Most preferably, the nonionic surfactant useful in the present invention is selected from the group comprising linear and branched fatty alcohol ethoxylates with a carbon chain of about 6 to about 22 and from about 1 to about 25 moles of ethylene oxide, more preferably with a carbon chain of from about 8 to about 15 and from about 2 to about 13 moles of ethylene oxide and an HLB of about 8 to about 16 and mixtures thereof. Most preferably, the fatty alcohol ethoxylate has a carbon chain of from about 9 to about 11 with from about 5 to about 10 moles of ethylene oxide and an HLB of from about 11 to about 14 and mixtures thereof. Useful fatty alcohol ethoxylates are those marketed under the trademark NEODOL®, and in particular NEODOL® 1–7 manufactured by Shell Corporation.

In one embodiment of the composition of the present invention, the nonionic surfactant is present in a range of from about 10% to about 90%, more preferably from about 20% to about 80%, and most preferably in a range of from about 60% to about 80%. In another embodiment of the composition of the present invention, the nonionic surfactant preferably is present in a range of from about 10% to about 90%, more preferably in a range of from about 25% to about 75% and most preferably in the range of 45% to 60% with 50% to 55% being optimal.

Amide Cosurfactant

The amide cosurfactant useful in the present invention is preferably selected from the group of fatty acid alkanolamides derived from the condensation reaction of saturated and unsaturated triglycerides with an alkanol amine. Preferably, the amide cosurfactant has an acyl moiety of from about 6 to about 22 carbon atoms, more preferably from about 8 to about 18 carbon atoms and most preferably the carbon chain distribution found in coconut oil glycerides. These acyl moieties may be derived not only from naturally occurring glycerides, e.g., coconut oil, palm oil, soybean oil and tallow, but also can be derived synthetically, e.g., by the oxidation of petroleum or by the hydrogenation of carbon monoxide by the Fischer-Tropsch process. The C2–$C_4$ monoalkanol- and dialkanolamides of $C_6$–$C_{22}$ fatty acids and mixtures thereof, the $C_2$–$C_4$ dialkanolamides of $C_8$–$C_{18}$ fatty acids and mixtures thereof and the $C_2$–$C_4$ dialkanolamides of coconut oil fatty acids and mixtures thereof are preferred. More preferred are the $C_2$–$C_4$ dialkanolamides of $C_8$–$C_8$ fatty acids and mixtures thereof. The diethanolamide of coconut fatty acids and mixtures thereof are most preferred and are exemplified by NINOL 40–$C_0$ by Stepan Company and MONAMID 705 by Mona Industries, Inc.

In one embodiment of the composition of the present invention, the amide cosurfactant is present in a range of from about 10% to about 90%, more preferably from about 20% to about 80%, and most preferably from about 20% to about 40%. In another embodiment of the composition of the present invention, the amide cosurfactant is present in a range of from about 10% to about 90%, more preferably from about 15% to about 60% and most preferably from about 20% to about 30% with 20% to 25% being optimal.

While problems are often encountered with gelling, dilutability and dispersibility when attempting to achieve high active level compositions of nonionic surfactants such as fatty alcohol ethoxylates, alkyl phenol ethoxylates or alkyl polyglycosides alone or in combination with other cosurfactants, it was surprisingly found that by adding the amide cosurfactant, and most preferably a diethanolamide of a coconut fatty acid, that a composition was obtained that shows good homogeneity, low viscosity, dispersibility in water without gelling and rapid dilutability.

Optional Secondary Surfactants

The compositions of the present invention can be supplemented with an optional secondary surfactant. This component may be desirable to modify foaming characteristics or to augment performance for specific applications. The secondary surfactant can be selected from a wide range of substantially any liquid of liquefiable anionic, cationic, nonionic, amphoteric or betaine surfactants. These surfactants can be used singly or in mixtures in amounts of up to about 10%, more preferably from about 1% to about 8%. Most preferably, the optional secondary surfactant is present in the range of from about 1.5% to about 5%.

Suitable anionic surfactants are the water-soluble salts of alkyl benzene sulfonates, alkyl sulfates, alkyl polyethoxy ether sulfates, paraffin sulfonates, alpha-olefin sulfonates, alpha-sulfocarboxylates and their esters, alkyl glyceryl ether sulfonates, fatty acid monoglyceride sulfates and sulfonates and alkyl phenol polyethoxy ether sulfates. Without limitation, further anionic surfactants which can be used in the present invention are set forth in *McCutcheon's Detergent and Emulsifiers* 1993 Annual and U.S. Pat. No. 3,929,678.

A preferred class of anionic surfactants includes the watersoluble salts, particularly the alkali metal, ammonium and alkanolammonium salts of organic compounds containing sulfur and having in their molecular structure an alkyl or alkaryl group containing from about 8 to about 22, especially from about 10 to about 20 carbon atoms and a sulfonic acid or sulfuric acid ester group. Examples of this class of surfactants are the sodium and potassium alkyl sulfates, especially the sulfates of the higher ($C_8$–$C_8$) alcohols and the sodium and potassium alkyl benzene sulfonates in which the alkyl group contains from about 9 to about 15, preferably about 11 to about 13, carbon atoms. A more preferred class of anionic surfactants are those selected from the $C_8$–$C_{18}$ ethoxylated sulfates with from about 1 to about 5 moles of ethylene oxide. More preferably, the anionic surfactant useful in the present invention is selected from $C_{12}$ sodium ethoxy sulfate with about 3 moles of ethylene oxide and $C_{12}$ ammonium ethoxy sulfate with about 3 moles of ethylene oxide. Most preferably, the anionic surfactant is sodium lauryl ether sulfate as exemplified by STEOL® CS-460 from Stepan Company and NEODOL®25-3S from Shell Chemical Company.

Suitable nonionics which can be useful as a secondary surfactant in the present invention would include all nonionic surfactants other than ethoxylated alcohols, alkyl phenols and alkyl polyglycosides such as the $C_8$–$C_{18}$ alkyl amine oxides. Nonionics useful in the present invention are those found in *McCutcheon's Detergents and Emulsifiers* 1993 Annual and U.S. Patent No. 3,929,678.

Suitable cationic surfactants include various quaternary ammonium compounds having the general structure:

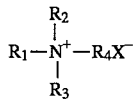

and are used in the present invention only in the absence of incompatible anionics. Suitable cationic surfactants include those which provide antimicrobial activity at dilute concentrations such as alkyl dimethyl benzyl ammonium compounds where $R_1$ is a $C_{12}$–$C_{18}$ alkyl group, $R_2$ and $R_3$ are methyl groups, $R_4$ is a benzyl group and $x^-$ is a $Cl^-$, $Br^-$ or $CH_3{}^-SO_4{}^-$. Exemplary cationic surfactants are those sold under the trade name BTC® by Stepan Company.

Suitable amphoteric surfactants are the water-soluble derivatives of aliphatic secondary and tertiary amines where one of the aliphatic substituents contains from about 8 to about 18 carbon atoms and one contains an anionic water-solubilizing group such as carboxyl, sulfonate, sulfate, phosphate or phosphonate. Also included are the betaine surfactants conforming to the structure:

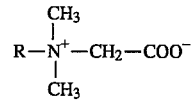

and include cocamidopropyl betaine such as VARION® CADG marketed by Witco Corporation.

Hydrotropes

Hydrotropes are optional in the compositions of the present invention. However, as the cleaning composition exists in the liquid form, hydrotropes can be added when the composition contains water to enhance phase stability. Hydrotropes useful in the present invention include conventional hydrotropes useful in a detergent system and without limitation include $C_4$–$C_{10}$ alkyl and $C_1$–$C_6$ alkyl-aryl mono- and disulfonates, sulfates, phosphates, phosphorates and carboxylates derived from aliphatic, olefinic and alkyl-aromatic hydrocarbons and their related esters and polyethers; amphoterics, water miscible alcohols, polyols, polyol ethers and mixtures thereof. More preferably, the hydrotropes of the composition of the present invention include water miscible alcohols, polyols and polyol ethers and mixtures thereof. Most preferably, the hydrotrope of the present invention is propylene glycol and is exemplified by propylene glycol, industrial grade, from Dow Chemical and propylene glycol, technical grade, from Eastman Chemical.

The hydrotropes of the present invention are preferably present in a range from about 0% to about 15%, more preferably from about 4% to about 13% and most preferably from about 8% to about 12%.

pH Control Agents

A pH control agent is optional in the compositions of the present invention and is added in an amount as needed to keep the composition at a preferred pH of from about 4 to about 10, more preferably at a pH of from about 5 to about 9 and most preferably at a pH of from about 6.5 to about 7.1. While various pH control agents known in the art can be used, preferred are the monoprotic acids, more preferably acetic and hydroxy acetic acid and most preferably acetic acid in the range of from about 0,5% to about 1.5%, preferably 0.7% to about 0.9%. A preferred acetic acid useful in the present invention is exemplified by glacial acetic acid from Hoechst Celanese.

Water And Optional Ingredients

Water and optional ingredients can also be included in the compositions of the present invention in a preferred range of from about 0% to about 50%, more preferably from about 5% to about 20% and most preferably from about 8% to about 14%. The water added is most preferably softened or deionized. Optional ingredients conventionally employed in detergent compositions including adjuvants, dilutants, dyes, fragrances, denaturing agents, preservatives, suds regulating or suppressing agents and others can be used in the compositions of the present invention without detracting from the advantageous properties of the compositions. Preferably, the compositions of the present invention do not contain extraneous ingredients such as builder salts which compromise the stability of the compositions.

Methods Of Manufacture

The concentrated all-purpose liquid cleaning composition of the present invention is manufactured through typical processes such as mixing or blending the composition and is typically prepared through the sequential addition of ingredients to the mixing vessel with low or moderate shear mixing provided by a turbine propeller, impellers or the like with order of addition and temperature suitable to the specific ingredients chosen. In one example, water as necessary is added to the mix vessel, followed by the amide, the nonionic surfactant(s) and the desired optional ingredients with continuous low speed mixing at ambient temperatures.

Use Procedures

In one embodiment of the composition of the present invention the high active compositions are useful as a detergent base for fully formulated liquid and powder heavy duty and light duty cleaning compositions. Most preferably the high active composition is used as a high active detergent base for consumer and industrial-related cleaning products. In another embodiment of the compositions of the present invention, the composition is used neat or first diluted with water to the preferred strength of the end user. This dilution can take place in a bucket or other containment device. The dilution by the end user can be in a bucket dilution in a ratio of from 1:1 to 1:2000 of cleaning composition to water. The dilution can also take place in a spray cleaner application such as that found in U.S. Pat. Nos. 5,152,461 and 5,332,157 in a ratio of from about 1:1 to about 1:250. When using this latter method, the all-purpose liquid cleaning composition is placed in its concentrated form in a bottle approximately 250 ml in size and attached to the sprayer device containing another similar bottle filled with water. The end user simply manipulates the concentration ratio and applies the cleaning composition to the surface to be cleaned and thereafter wipes the cleaning composition and entrained soil from said surface.

EXAMPLES

The following examples are provided by way of explanation and description and should not be seen as limiting the scope of the invention.

In the examples that follow, the abbreviations used have the following descriptions:

AE—Primary alcohol ethoxylate marketed under the trade name NEODOL® 1–7 by Shell Chemical Company CDEA—Coconut diethanolamide marketed under the trade name NINOL 40–CO by Stepan Company SLES—Sodium lauryl ether sulfate (60% active) marketed under the trade name STEOL CS-460 by Stepan Company CAPAO—Cocamidopropyl amine oxide (35% active) marketed under the trade name VAROX 1770 by Witco Corporation CAPB—Cocamidopropyl betaine (35% active) marketed under the trade name VARION® CADG by Witco Corporation DPM—Dipropylene glycol methyl ether marketed under the trademark DOWANOL DPM by Dow Chemical Company HOAC—Glacial acetic acid such as that manufactured by Hoechst Celanese PG—Propylene glycol such as that marketed as technical grade by Dow Chemical Company EtOH—Denatured ethanol such as that marketed as SD ALCOHOL 40 by Shell Chemical Company APE—Alkyl phenol ethoxylate sold under the trade name TRITON N-Ill by Union Carbide Corporation SAE Secondary alcohol ethoxylate sold under the trade name TERGITOL 15-S-12 by Union Carbide Corporation APG Alkyl polyglycoside such as that marketed under the name GLUCOPON 425CS by Henkel Corporation, dried to produce a 100% active form FRG—Fragrance $H_2O$—Water The following liquid Compositions 1 through 12 were prepared by mixing the following components in a standard mixing vessel at room temperature.

| | Compositions 1–6 (% by weight) | | | | | |
|---|---|---|---|---|---|---|
| Component | 1 | 2 | 3 | 4 | 5 | 6 |
| Water | 11.10 | 11.10 | 11.10 | 10.80 | 10.80 | 10.80 |
| PG | 10.00 | — | — | 10.00 | — | — |
| EtOH | — | 10.00 | — | — | 10.00 | — |
| DPM | — | — | 10.00 | — | — | 10.00 |
| CDEA | 23.00 | 23.00 | 23.00 | 21.60 | 21.60 | 21.60 |
| AE | 55.00 | 55.00 | 55.00 | 53.70 | 53.70 | 53.70 |
| SLES | — | — | — | 3.00 | 3.00 | 3.00 |
| CAPAO | — | — | — | — | — | — |
| CAPB | — | — | — | — | — | — |
| HOAC | 0.80 | 0.80 | 0.80 | 0.80 | 0.80 | 0.80 |
| FRG | 0.10 | 0.10 | 0.10 | 0.10 | 0.10 | 0.10 |
| TOTALS | 100.00 | 100.00 | 100.00 | 100.00 | 100.00 | 100.00 |

| | Compositions 7–12 (% by weight) | | | | | |
|---|---|---|---|---|---|---|
| Component | 7 | 8 | 9 | 10 | 11 | 12 |
| Water | 7.80 | 7.80 | 7.80 | 7.80 | 7.80 | 7.80 |
| PG | 10.00 | — | — | 10.00 | — | — |
| EtOH | — | 10.00 | — | — | 10.00 | — |
| DPH | — | — | 10.00 | — | — | 10.00 |
| CDEA | 21.60 | 21.60 | 21.60 | 21.60 | 21.60 | 21.60 |
| AE | 53.70 | 53.70 | 53.70 | 53.70 | 53.70 | 53.70 |
| SLES | — | — | — | — | — | — |
| CAPAO | 6.00 | 6.00 | 6.00 | — | — | — |
| CAPB | — | — | — | 6.00 | 6.00 | 6.00 |
| HOAC | 0.80 | 0.80 | 0.80 | 0.80 | 0.80 | 0.80 |
| FRG | 0.10 | 0.10 | 0.10 | 0.10 | 0.10 | 0.10 |
| TOTALS | 100.00 | 100.00 | 100.00 | 100.00 | 100.00 | 100.00 |

Compositions 1 through 12 are considered to be within the scope of the concentrated all-purpose liquid cleaning composition of the present invention with Composition 4 exemplifying the most preferred embodiment. Compositions 1 through 12, while containing high amounts of actives, were surprisingly found to be homogeneous, rapidly dilutable and dispersible in water without gelling.

| | Cleaning Performance (Compositions 1–6) | | | | | |
|---|---|---|---|---|---|---|
| Composition | 1 | 2 | 3 | 4 | 5 | 6 |
| Performance | 75% | 65% | 65% | 65% | 65% | 65% |
| | Cleaning Performance (Compositions 7–12) | | | | | |
| Composition | 7 | 8 | 9 | 10 | 11 | 12 |
| Performance | 40% | 55% | 55% | 45% | 40% | 50% |

Compositions 1 through 12 were evaluated for cleaning performance as follows. Soil removal testing was conducted according to ASTM Method D4488. White vinyl tiles (VPI 502S tile stock) were soiled with 0.5 grams of the soil mixture specified in ASTM D4488 Annex A3. Tiles were conditioned and then scrubbed for 25 cycles with a 1:250 dilution of the example compositions (1-12) in water using a Gardco Model D16VF straight-line washability apparatus. Reflectance measurements used to determine cleaning efficiency were made using a Hunter MiniScan spectrophotometer (Model No. MS-4500L). Testing was performed at 25° C. The 1:250 dilutions of Compositions 1 through 12 were found to have good-excellent cleaning performance.

| Viscosity Measurement (Compositions 1–6) | | | | | | |
|---|---|---|---|---|---|---|
| Composition | 1 | 2 | 3 | 4 | 5 | 6 |
| #4 Ford Cup Viscosity (seconds) | 26.9 | 17.1 | 22.1 | 26.7 | 17.1 | 22.0 |

| Viscosity Measurement (Compositions 7–12) | | | | | | |
|---|---|---|---|---|---|---|
| Composition | 7 | 8 | 9 | 10 | 11 | 12 |
| #4 Ford Cup Viscosity (seconds) | 28.4 | 17.5 | 22.7 | 27.6 | 17.5 | 22.4 |

Compositions 1 through 12 were evaluated for viscosity as follows. A sample of the composition was placed into a #4 Ford Viscosity Cup. Time taken for the sample to flow through a narrow orifice at the cup bottom was measured and reported in seconds. Testing was performed at 25° C. All compositions demonstrated very low viscosity for their actives levels.

| pH Measurement (Compositions 1–6) | | | | | | |
|---|---|---|---|---|---|---|
| Composition | 1 | 2 | 3 | 4 | 5 | 6 |
| pH | 6.8 | 6.9 | 7.0 | 7.0 | 7.0 | 7.0 |

| pH Measurement (Compositions 7–12) | | | | | | |
|---|---|---|---|---|---|---|
| Composition | 7 | 8 | 9 | 10 | 11 | 12 |
| pH | 7.1 | 7.0 | 7.2 | 6.9 | 7.2 | 6.9 |

Compositions 1 through 12 were measured for pH. Compositions 1 through 12 were tested "as is" (undiluted) using a Corning Model 240 pH Meter with a Corning General Purpose Combination Electrode (No. 476530).

Composition 4 was evaluated for resistance to microorganism attack. Testing was performed by inoculating the composition with $10^7$ bacterial and 106 fungi organisms per gram of product sample. A composition is deemed hostile if it is found to be free from microorganisms (<1 organism in 10 grams of product) in less than 7 days following inoculation.

It was surprisingly found that even though Composition 4 contained water and was of neutral pH, it tested hostile to microbes. This surprising result allows for the manufacture of a high active concentrated cleaning product without the addition of antimicrobial agents. Based on the similarities among Compositions 1 through 12, all could be expected to share the self-preserved characteristic shown by Composition 4.

The following liquid Compositions 13 through 23 were prepared by mixing the following components in a standard mixing vessel at room temperature.

| Compositions 13–23 (% by weight) | | | | | | | | | | | |
|---|---|---|---|---|---|---|---|---|---|---|---|
| | 13 | 14 | 15 | 16 | 17 | 18 | 19 | 20 | 21 | 22 | 23 |
| CDEA | 100 | 90 | 80 | 70 | 60 | 50 | 40 | 30 | 20 | 10 | — |
| AE | — | 10 | 20 | 30 | 40 | 50 | 60 | 70 | 50 | 90 | 100 |

Compositions 14 through 22 are considered to be within the scope of the high active detergent base compositions of the present invention with Composition 20 exemplifying the most preferred embodiment. Compositions 14 through 22, while being 100% active blends, were surprisingly found to be homogeneous, flowable liquids having low to moderate viscosities at room temperature, with rapid dilutability and dispersibility in water without gelling.

| Viscosity (Compositions 13–17) | | | | | |
|---|---|---|---|---|---|
| Composition | 13 | 14 | 15 | 16 | 17 |
| #4 Ford Cup Viscosity (seconds) | 313 | 225 | 150 | 103 | 72.1 |

| Viscosity (Compositions 18–23) | | | | | | |
|---|---|---|---|---|---|---|
| Composition | 18 | 19 | 20 | 21 | 22 | 23 |
| #4 Ford Cup Viscosity (seconds) | 51.4 | 35.1 | 27.2 | 22.0 | 18.7 | 16.5 |

Compositions 13 through 23 were tested for viscosity as follows. A sample of the composition was placed into a #4 Ford Viscosity Cup. Time taken for the sample to flow through a narrow orifice at the cup bottom was measured and reported in seconds. Testing was performed at 25° C.

The viscosity of Compositions 13 through 23 can be viewed on FIG. 1. As indicated in FIG. 1, Compositions 14 through 22, containing both alcohol ethoxylate and amide, were shown to be lower in viscosity than expected by interpolations based on the viscosities of each surfactant component. This synergy found for the alcohol ethoxylate/amide blends is particularly useful for applications requiring a fluid composition of low viscosity.

| Dissolution Rate (Compositions 13–17) (0.2% Solution) | | | | | |
|---|---|---|---|---|---|
| Composition | 13 | 14 | 15 | 16 | 17 |
| Dissolution Rate (seconds) | 130 | 81.2 | 45.0 | 39.3 | 37.8 |

| Dissolution Rate (Compositions 18–23) (0.2% Solution) | | | | | | |
|---|---|---|---|---|---|---|
| Composition | 18 | 19 | 20 | 21 | 22 | 23 |
| Dissolution Rate (seconds) | 34.5 | 29.3 | 25.0 | 23.7 | 80.3 | >180 (gelled) |

Compositions 13 through 23 were tested for dissolution by taking 0.1 gram of each composition and dispensing it into 50 grams of water using a small disposable pipet. A glass rod was used to consistently agitate the mixture until no trace of undispersed surfactant material was present to an observer. The total time needed for complete dissolution was recorded.

Figure 2:
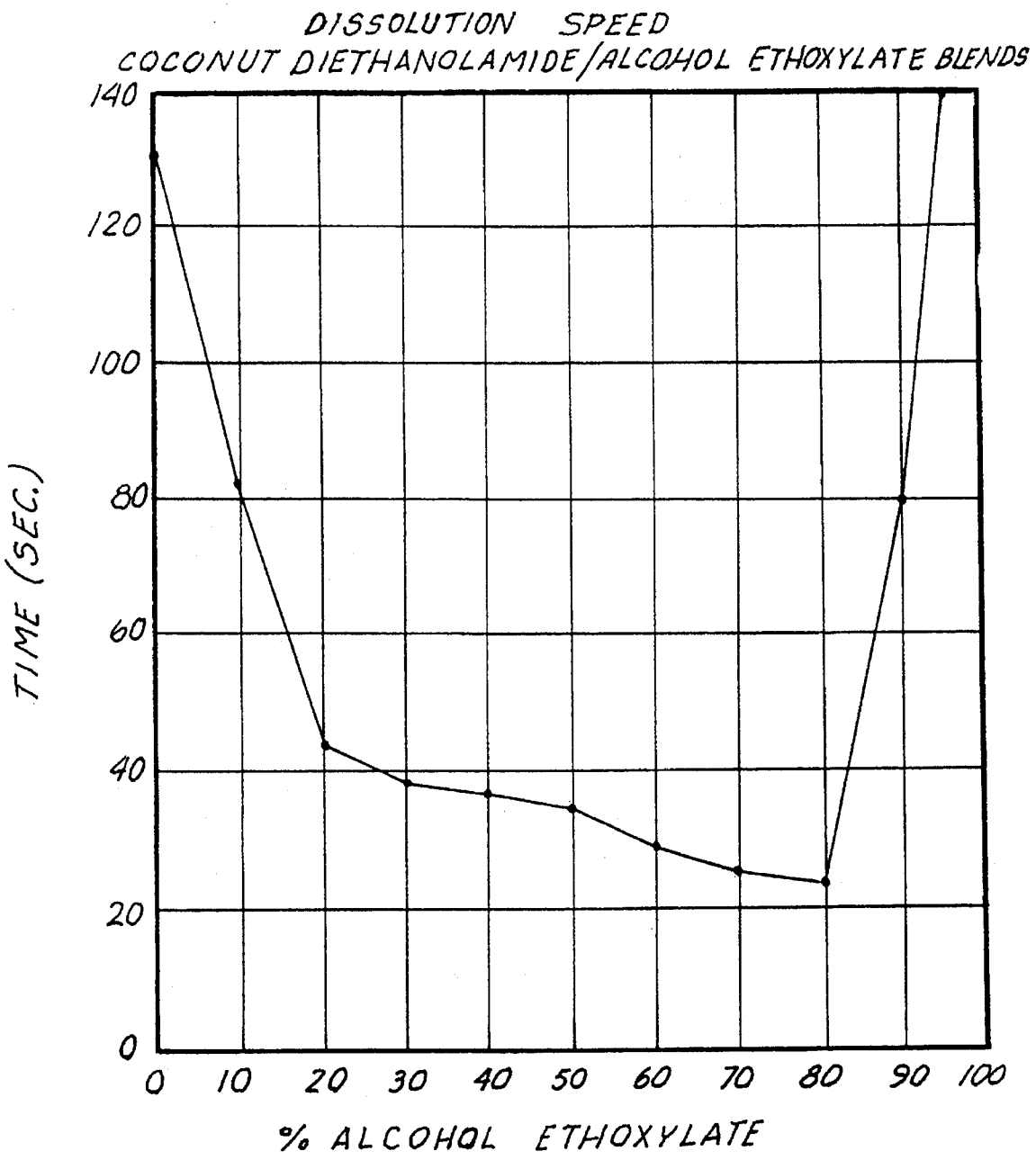
FIG. 2 is a graph depicting dissolution speeds for various blends of alcohol ethoxylate and coconut diethanolamide.

The dissolution rate of Compositions 13 through 23 can be viewed on FIG. 2. As indicated in FIG. 2, Compositions 14 through 22, containing both alcohol ethoxylate and amide, showed surprisingly rapid dissolution compared to that demonstrated by the individual surfactant components. This important synergy is of high value in both industrial blending and consumer dilution situations.

| | Clarity (Compositions 13–17) (25' C.) | | | | |
|---|---|---|---|---|---|
| Composition | 13 | 14 | 15 | 16 | 17 |
| Clarity | clear | clear | clear | clear | clear |

| | Solution Clarity (Compositions 18–23) (25' C.) | | | | | |
|---|---|---|---|---|---|---|
| Composition | 18 | 19 | 20 | 21 | 22 | 23 |
| Clarity | clear | clear | clear | clear | clear | hazy |

| | Clarity (Compositions 13–17) (0.2% Solution) | | | | |
|---|---|---|---|---|---|
| Composition | 13 | 14 | 15 | 16 | 17 |
| Clarity | cloudy | cloudy | cloudy | hazy | clear |

| | Solution Clarity (Compositions 18–23) (0.2% Solution) | | | | | |
|---|---|---|---|---|---|---|
| Composition | 18 | 19 | 20 | 21 | 22 | 23 |
| Clarity | clear | clear | clear | clear | clear | clear |

Compositions 13 through 23 were evaluated for solution clarity by placing 0.1 gram of the composition in 50 grams of water and observing the composition after complete dissolution.

Compositions 2 4 through 3 0 were prepared by mixing the following components in a standard mixing vessel at room temperature.

| | Compositions 24–30 (% by weight) | | | | | | |
|---|---|---|---|---|---|---|---|
| Composition | 24 | 25 | 26 | 27 | 28 | 29 | 30 |
| CDEA | 100% | 40 | 40 | 40 | — | — | — |
| AE | — | — | — | 60 | — | — | 100 |
| APE | — | 60 | — | — | 100 | — | — |
| SAE | — | — | 60 | — | — | 100 | — |

Compositions 25 through 27 are considered to be within the scope of the high active detergent base composition of the present invention. Compositions 24 through 30 were measured for viscosity, dissolution rate (0.2% solution), solution clarity (0.2% solution) and composition clarity (25° C.) according to the methods set forth above with the following results.

| Composition | 24 | 25 | 26 | 27 | 28 | 29 | 30 |
|---|---|---|---|---|---|---|---|
| Clarity (25° C.) | clear | clear | clear | clear | clear | hazy | hazy |
| Viscosity (sec) | 313 | 99.2 | 54.4 | 35.1 | 70.1 | 30.0 | 16.5 |
| Dissolution Rate (sec) (0.2% solution) | 130 | 8 | 6 | 29 | 153 (gelled) | 86 (gelled) | >180 (gelled) |
| Solution Clarity (0.2% solution) | cloudy | clear | clear | clear | clear | clear | clear |

Compositions 31 and 32 were prepared by taking a sample of GLUCOPON 425CS (nominally 50% active in aqueous solution) and drying in either a vacuum oven at 70° C. or in a convection oven at 105° C. to remove the aqueous carrier. The resulting paste was then blended with amounts of propylene glycol (control) or a mixture of amide with propylene glycol in a standard mixing vessel at room temperature.

| | Compositions 31 and 32 (% by weight) | |
|---|---|---|
| Composition | 31 | 32 |
| APG (dried) | 45 | 90 |
| CDEA | 45 | — |
| PG | 10 | 10 |

Composition 31 is considered to be within the scope of the high active detergent base compositions of the present invention. Compositions 31 and 32 were measured for viscosity, dissolution rate (0.2 % solution), solution clarity (0.2% solution) and composition clarity (25° C.) according to the methods set forth above with the following results.

| Composition | 31 | 32 |
|---|---|---|
| Clarity (25' C.) | clear | clear |
| Viscosity Character | high | high |
| Dissolution Rate (0.2% solution) | 13 S | 45 S |
| Solution Clarity (0.2% solution) | clear | clear |

Of course, it should be understood that a wide range of changes, modifications and equivalents could be made to the embodiments described above. It is therefore intended that the above descriptions illustrate, rather than limit, the invention and that it is the following claims, including all equivalents, which define the compositions and methods of use of the compositions of the present invention. It is to be understood that the percentages as recited in the claims are intended to be based on the total weight of the composition.

What is claimed is:

1. A concentrated all-purpose liquid cleaning composition with actives levels of greater than 65% consisting essentially of, by weight based on total weight of the composition:

(a) from about 25% to about 75% of a fatty alcohol ethoxylate selected from the group consisting of $C_9$–$C_{11}$ alcohol ethoxylates with from about 5 to about 10 moles of ethylene oxide and an HLB of from about 11 to about 14;

(b) from about 20% to about 60% of diethanolamide of coconut fatty acid;

(c) up to about 8% of a secondary surfactant;

(d) up to about 13% of a hydrotrope; and (e) water.

2. The concentrated all-purpose liquid cleaning composition of claim 1 wherein said secondary surfactant is selected from the group consisting of anionic surfactants, nonionic surfactants, amphoteric surfactants, cationic surfactants and mixtures thereof.

3. The concentrated all-purpose liquid cleaning composition of claim 1 wherein said secondary surfactant is selected from the group consisting of anionic surfactants.

4. The concentrated all-purpose liquid cleaning composition of claim 3 wherein said secondary surfactant is sodium lauryl ether sulfate.

5. The concentrated all-purpose liquid cleaning composition of claim 1 wherein said hydrotrope is propylene glycol.

6. The concentrated all-purpose liquid cleaning composition of claim 1 wherein said composition is diluted by an end user in the ratio of 1:1 to 1:2000 cleaning composition to water.

7. The concentrated all-purpose liquid cleaning composition of claim 1 wherein said composition is diluted by an end user in the ratio of 1:1 to 1:250 cleaning composition to water.

8. A concentrated all-purpose liquid cleaning composition with actives levels of greater than 65% consisting essentially of, by weight based on total weight of the composition:

(a) from about 45% to about 60% of a fatty alcohol ethoxylate selected from the group consisting of $C_9$–$C_{11}$ alcohol ethoxylates with from about 5 to about 10 moles of ethylene oxide and an HLB of from about 11 to about 14;

(b) from about 20% to about 30% of a diethanolamide of coconut fatty acid;

(c) up to about 5% of a secondary surfactant;

(d) up to about 12% of a hydrotrope;

(e) optionally from about 0.5% to about 1.5% of acetic acid; and (f) water.

9. The concentrated all-purpose liquid cleaning composition of claim 8 wherein said hydrotrope is propylene glycol.

10. A high active detergent base composition with actives levels of greater than 65% consisting essentially of, by weight based on total weight of the composition:

(a) from about 20% to about 80% of a fatty alcohol ethoxylate selected from the group consisting of $C_9$–$C_{11}$ alcohol ethoxylates with from about 5 to about 10 moles of ethylene oxide and an HLB of from about 11 to about 14;

(b) from about 80% to about 20% of a diethanolamide of coconut fatty acid;

(c) up to 10% of a secondary surfactant;

(d) up to 12% of a hydrotrope; and (e) optionally from about 0.5 to about 1.5% of a pH control agent.

11. A method for cleaning a variety of surfaces with a concentrated all-purpose liquid cleaning composition comprising the steps of:

(1) diluting with water in a ratio acceptable to the end user a concentrated all-purpose liquid cleaning composition with actives levels of greater than 65% consisting essentially of, by weight based on total weight of the composition:

(a) from about 25% to about 75% of a fatty alcohol ethoxylate selected from the group consisting of $C_9$–$C_{11}$ alcohol ethoxylates with from about 5 to about 10 moles of ethylene oxide and an HLB of from about 11 to about 14;

(b) from about 20% to about 60% of a diethanolamide of coconut fatty acid;

(c) up to about 10% of a secondary surfactant selected from the group consisting of anionic surfactants, nonionic surfactants, amphoteric surfactants, betaines and mixtures thereof;

(d) up to about 15% of a hydrotrope; and (e) up to about 50% water;

(2) applying said liquid cleaning composition to the surface to be cleaned; and (3) wiping from said surface said liquid cleaning composition along with entrained soil.

12. A method of formulating a high actives end user cleaning product with a high active detergent base composition comprising the steps of:

(1) mixing a high active detergent base composition with an actives level of greater than 65% consisting essentially of, by weight based on total weight of the composition:

(a) from about 20% to about 80% of a fatty alcohol ethoxylate selected from the group consisting of $C_9$–$C_{11}$ alcohol ethoxylates with from about 5 to about 10 moles of ethylene oxide and an HLB of from about 11 to about 14;

(b) from about 20% to about 80% of a diethanolamide of coconut fatty acid; and (2) adding to said high actives detergent base composition one or more of solvents, water, pH control ingredients, secondary surfactants and other detergent additives such as dyes, fragrances, and foam control agents.

* * * * *